US008784001B1

(12) United States Patent
Phillips et al.

(10) Patent No.: US 8,784,001 B1
(45) Date of Patent: Jul. 22, 2014

(54) OIL FIELD RIG MAT ASSEMBLY

(71) Applicant: HB Green Resources, LLC, Lafayette, LA (US)

(72) Inventors: Mark Leon Phillips, Lafayette, LA (US); Kenneth Ray Boersma, Wadsworth, OH (US)

(73) Assignee: HB Green Resources, LLC, Lafayette, LA (US)

( * ) Notice: Subject to any disclaimer, the term of this patent is extended or adjusted under 35 U.S.C. 154(b) by 0 days.

(21) Appl. No.: 13/772,271

(22) Filed: Feb. 20, 2013

Related U.S. Application Data

(60) Provisional application No. 61/655,326, filed on Jun. 4, 2012.

(51) Int. Cl.
*E01C 5/00* (2006.01)
*E21B 41/00* (2006.01)
*E01C 5/18* (2006.01)

(52) U.S. Cl.
CPC ..... *E21B 41/0021* (2013.01); *E01C 5/18* (2013.01); *E01C 2201/16* (2013.01)
USPC ..... 404/35; 404/44; 404/46

(58) Field of Classification Search
USPC ..... 404/19, 20, 34–38, 44, 46
See application file for complete search history.

(56) References Cited

U.S. PATENT DOCUMENTS

| | | | | | |
|---|---|---|---|---|---|
| 1,828,193 | A * | 10/1931 | Levin | 52/388 |
| 4,462,712 | A * | 7/1984 | Penland, Sr. | 404/36 |
| 4,600,336 | A * | 7/1986 | Waller, Jr. | 404/35 |
| 4,875,800 | A * | 10/1989 | Hicks | 404/35 |
| 4,973,193 | A * | 11/1990 | Watson et al. | 404/35 |
| 5,032,037 | A * | 7/1991 | Phillips et al. | 404/73 |
| 5,316,408 | A * | 5/1994 | Stanley et al. | 404/35 |
| 5,822,944 | A * | 10/1998 | Penland, Sr. | 52/591.1 |
| 6,380,309 | B1 | 4/2002 | Parker et al. | |
| 6,474,905 | B1 * | 11/2002 | Smith et al. | 404/35 |
| 6,945,732 | B2 * | 9/2005 | Renick | 404/35 |
| 7,413,374 | B2 * | 8/2008 | Rogers et al. | 404/35 |
| 7,500,336 | B2 * | 3/2009 | McGivern et al. | 52/650.3 |
| 7,985,475 | B2 | 7/2011 | Dubrow | |
| 2002/0110418 | A1 * | 8/2002 | Renick | 404/35 |

FOREIGN PATENT DOCUMENTS

JP 01239202 A * 9/1989 ..... E01C 9/08

* cited by examiner

*Primary Examiner* — Thomas B Will
*Assistant Examiner* — Jessica H Lutz
(74) *Attorney, Agent, or Firm* — Buskop Law Group, PC; Wendy Buskop

(57) ABSTRACT

An oil field mat assembly having a pair of interlocking full mats connected by interlocking half mats. Each full mat has a bottom layer, a bottom interlocking segment formed on the bottom layer, a middle layer, an alignment control means, a top layer, a top interlocking segment formed on the top layer on the same side that the top layer connects to the middle layer, and an anti-curling bar.

14 Claims, 7 Drawing Sheets

OIL FIELD RIG MAT ASSEMBLY

CROSS REFERENCE TO RELATED APPLICATION

The current application claims priority to and the benefit of U.S. Provisional Patent Application Ser. No. 61/655,326 filed on Jun. 4, 2012, entitled "OIL FIELD MAT ASSEMBLY". This reference is hereby incorporated in its entirety.

FIELD

The present embodiments generally relate to an oil field rig mat assembly.

BACKGROUND

A need exists for a synthetic, easy to install, easy to remove, highly durable modular mat that can withstand extreme temperatures for use around oil field equipment.

A further need exists for an oil field mat assembly that is safer for personnel, and maintains the original mat shape regardless of torque applied to the mat, weight applied to the mat, or movement applied to the mat assembly.

There exists a need to use recycled milk cartons, diaper backings, used grocery bags, and other post-consumer and postindustrial plastic scrap to reduce landfill. This oil field rig mat enables reduction in landfills because it is made from these materials.

The oil field modular, pin-less rig mat of recycled plastic creates a highly usable safety product for the oil rig.

The present embodiments meet these needs.

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments generally relate to an oil field mat assembly.

The present embodiments further relate to a tri-layer oil field support mat usable to support trucks, equipment, and personnel around a derrick or a Christmas tree.

The assembly provides increased safety on an oil rig, and avoids rig workers breaking legs, because the mats interconnect securely and will not shift when weight is applied to the mats.

The invention provides oil mats that are less slippery, because of using boards that allows easy water drainage off the boards, so that oil field workers don't slip and fall.

The assembly provides improved traction, and better surface conditions for oil field hands, enabling oil field workers in rain conditions to not have to wear ice grippers on their shoes.

The assembly uses only recycled plastics, both post-consumer and post-commercial plastic to form the mats.

The assembly protects the oil field rig containment liners to prevent punctures, enabling the liner to contain any oil rig spillage.

The assembly enables the oil field rig to maintain the underlying land and aquifer free of oil field toxins by protecting the oil field rig containment liners from ripping due to the ability of the mats to support heavy equipment movement without moving because of their unique interlocking design.

The assembly is pressure washable, moveable, and relocatable, enabling the mats to be easily cleaned, thus preventing oil field fluids, such as drilling muds from inadvertently flowing off the mats during movement, preventing toxins from flowing into aquifers while the mats are being moved.

Figure 1:
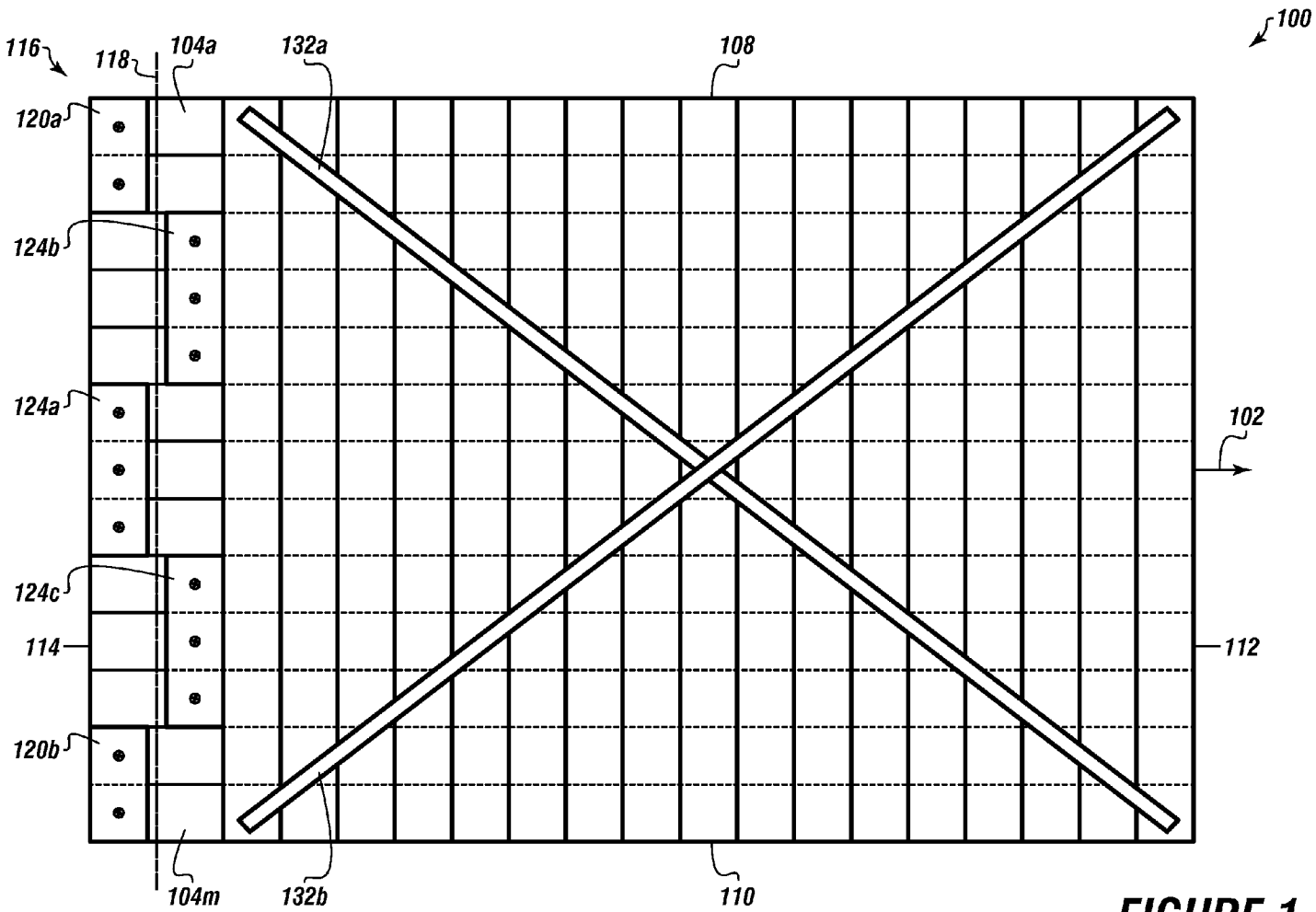
FIG. 1 shows a bottom layer with interlocking segments and an alignment control means.

Turning now to the Figures, FIG. 1 shows a bottom layer of an oil field mat with interlocking segments and alignment control means.

The bottom layer 100 with a bottom layer orientation 102, which can be formed from a plurality of bottom layer boards 104*a* and 104*m* which are connected together in parallel to each other. Each bottom layer board can have an identical board width.

The bottom layer can have four sides, a first bottom layer side 108, a second bottom layer side 110 opposite the first bottom layer side, a third bottom layer side 112, and a fourth bottom layer side 114.

In one or more embodiments, the third bottom layer side 112 and fourth bottom layer side can be between the first bottom layer side the and second bottom layer side and opposite each other.

In one or more embodiments, the bottom layer 100 can be formed from thirteen bottom layer boards connected in parallel with each other and having identical widths, lengths, and heights.

In other embodiments, the bottom layer 100 can use from eight bottom layer boards to twenty bottom layer boards.

In one or more embodiments, each bottom layer board can have a width ranging from about 5 inches to about 8 inches, a height ranging from about 1 inch to about 2 inches, and a length ranging from about 30 inches to about 192 inches.

In one or more embodiments, the bottom layer boards can have straight edges and in other embodiments, the bottom layer boards can be beveled on two sides. If the boards are beveled, water can more freely flow away from the mat to the liner of the oil field rig, allowing a safer footing for oil field workers.

A bottom interlocking segment 116 can include an interlocking segment centerline 118 passing from the first bottom layer side 108 to the second bottom layer side 110.

The bottom interlocking segment 116 can include a first half aligned locking board 120*a* mounted, such as in a flush configuration, with the first bottom layer side 108 and mounted adjacent the interlocking segment centerline 118, such as in a flush alignment.

The first half aligned locking board 120*a* is configured to prevent lateral and longitudinal movement of either a second interlocking full mat or an interlocking half mat.

The bottom interlocking segment 116 can include a second half aligned locking board 120*b* mounted proximate to the second bottom layer side 110 and mounted proximate to the interlocking segment center line 118 to prevent lateral and longitudinal movement of either a second interlocking full mat or an interlocking half mat. In embodiments, the second half aligned locking board 120*b* can be mounted flush with both the interlocking segment centerline 118 and the second bottom layer side 110.

The bottom interlocking segment 116 can include a first full aligned locking board 124*a* spaced apart from and mounted between the first and second half aligned locking boards 120*a* and 120*b*.

The first full aligned locking board 124*a* can be mounted flush with the interlocking segment centerline 118 and configured to prevent lateral and longitudinal movement of either a second interlocking full mat or an interlocking half mat.

The first and second half aligned locking boards and the first full aligned locking board 124*a* can be positioned on identical sides of the interlocking segment centerline 118.

The bottom interlocking segment 116 can include a second full aligned locking board 124*b* mounted between the first half aligned locking board 120*a* and the first full aligned locking board 124*a*.

The second full aligned locking board 124*b* can be mounted flush with the interlocking segment centerline 118 and configured to prevent lateral and longitudinal movement of either a second interlocking full mat or an interlocking half mat.

In one or more embodiments, the second full aligned locking board 124*b* can be spaced from about 1.5 to 2 board widths from the first bottom layer side 108.

The bottom interlocking segment 116 can include a third full aligned locking board 124*c*.

The third full aligned locking board 124*c* can be mounted between the first full aligned locking board 124*a* and the second half aligned locking board 120*b* to prevent lateral and longitudinal movement of either a second interlocking full mat or an interlocking half mat.

The third full aligned locking board 124*c* can be spaced from about 1.5 to 2 board widths from the second bottom layer side 110.

The second and third full aligned locking boards 124*b* and 124*c* can be positioned on identical sides of the interlocking segment centerline 118.

An alignment control means 132*a* and 132*b* can be used to maintain a preset geometric shape, such as a rectangle.

The alignment control means 132*a* and 132*b* can be disposed between the middle layer and the bottom layer connecting across all of the boards of the bottom layer and all of the boards of the middle layer, which is shown here as an "X-shape".

The alignment control means 132*a* and 132*b* can be created in the shape of a helix, a spiral, an X-shape, a W-shape, an M-shape, a pair of triangles; a V-shape, or a shape that covers at least 25 percent of the length of the boards. All alignment control means should connect to all of the boards of the bottom layer at least twice, simultaneously.

Figure 2A:
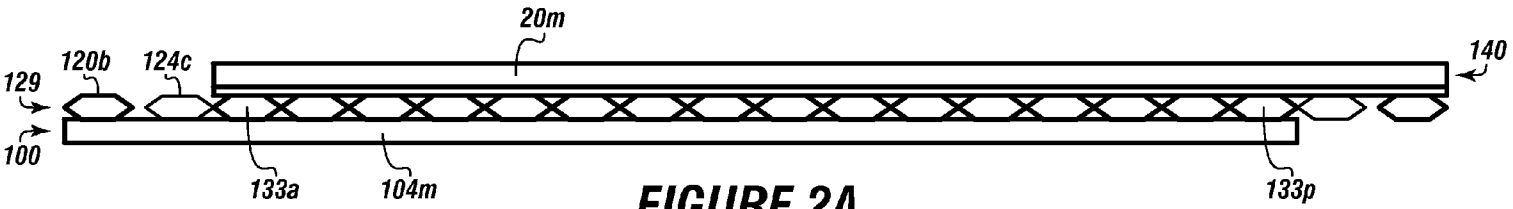
FIG. 2A shows a side view of a middle layer between a bottom layer and a top layer.

FIG. 2A shows a side view of a middle layer between a top layer and a bottom layer.

The middle layer 129 is formed from a plurality of parallel middle layer boards forming a middle layer orientation at a right angle to the bottom layer orientation.

The middle layer 129 can be formed from a plurality of middle layer boards 133*a* to 133*p*.

The plurality of middle layer boards 133*a* and 133*p* can be connected to the plurality of bottom layer boards 104*m* with fasteners.

The second half aligned locking board 120*b* and the third full aligned locking board 124*c* of the bottom interlocking segment is visible.

The top layer 140 is depicted and can be made from the plurality of top beveled boards 20*m* that can be in the same orientation as the plurality of bottom layer boards 104*m* of the bottom layer 100. In one or more embodiments, the top bevel boards and the bottom layer boards can be in parallel with the edges of each other.

Figure 2B:
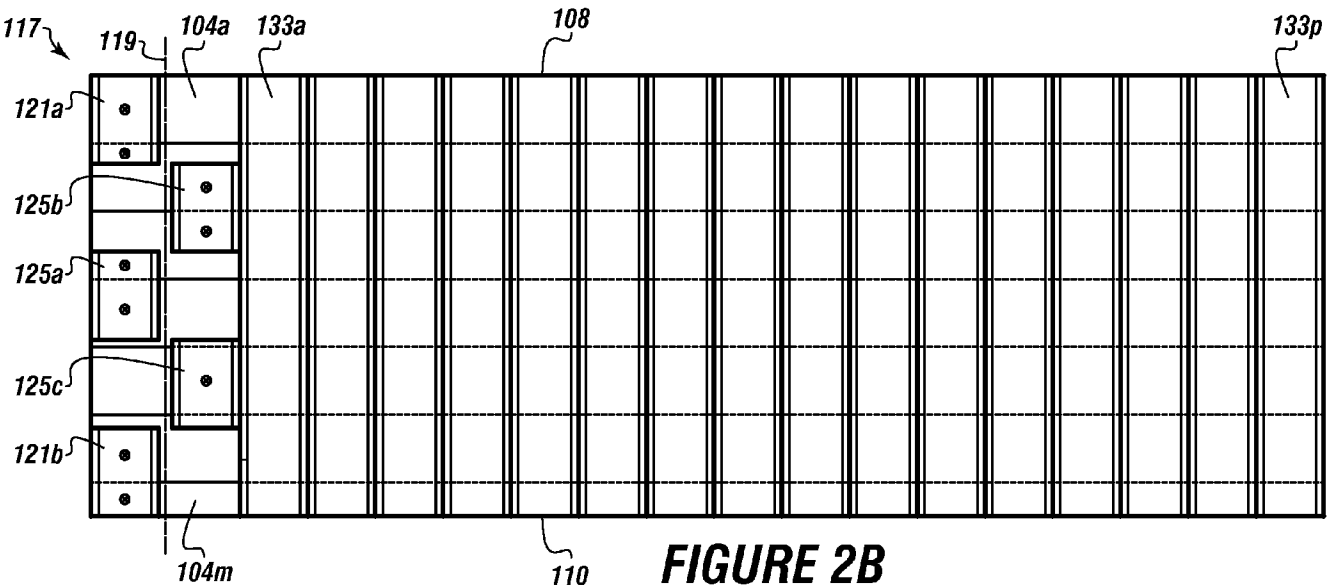
FIG. 2B shows a top view of the middle layer overlaid on the bottom layer with the aligned locking boards.

FIG. 2B shows a top view of the middle layer overlaid on the bottom layer with the aligned locking boards.

A first half aligned locking board 121*a* can be mounted with the first bottom layer side 108 and proximate to a interlocking segment centerline 119 of the bottom interlocking segment 117 and configured to prevent lateral and longitudinal movement of either an additional interlocking full mat or an additional interlocking half mat.

A second half aligned locking board 121*b* can be mounted proximate with the bottom layer side 110 and flush with the interlocking segment center line 119 to prevent lateral and longitudinal movement of either an additional interlocking full mat or an interlocking half mat.

A first full aligned locking board 125*a* can be spaced apart from and mounted between the first and second half aligned locking boards 121*a* and 121*b* the first full aligned locking board 125*a* can be mounted proximate with the interlocking segment centerline 119 and configured to prevent lateral and longitudinal movement of either an additional interlocking full mat or an additional interlocking half mat. The first and second half aligned locking boards 121*a* and 121*b*, and the first full aligned locking board 125*a* can be positioned on identical sides of the interlocking segment centerline 119.

A second full aligned locking board 125*b* can be mounted between the first half aligned locking board 121*a* and the second full aligned locking board 125*b* and can be mounted proximate with the interlocking segment centerline 119 and configured to prevent lateral and longitudinal movement of either an additional interlocking full mat or an interlocking half mat and wherein the second full aligned locking board can be spaced from about 1.5 and 2 board widths from the first bottom layer side 108.

A third full aligned locking board 125*c* can be mounted between the first full aligned locking board 125*a* and the second half aligned locking board 121*b* to prevent lateral and longitudinal movement of either an additional interlocking full mat or an interlocking half mat. The third full aligned locking board 125*c* can be spaced from about 1.5 and 2 board widths from the second bottom layer side 110. The second and third full aligned locking boards 125*b* and 125*c* can be positioned on identical sides of the interlocking segment centerline 119.

The plurality of middle layer boards 133*a* and 133*p* and the plurality of bottom layer boards 104*a* and 104*m* are shown in this Figure.

Figure 2C:
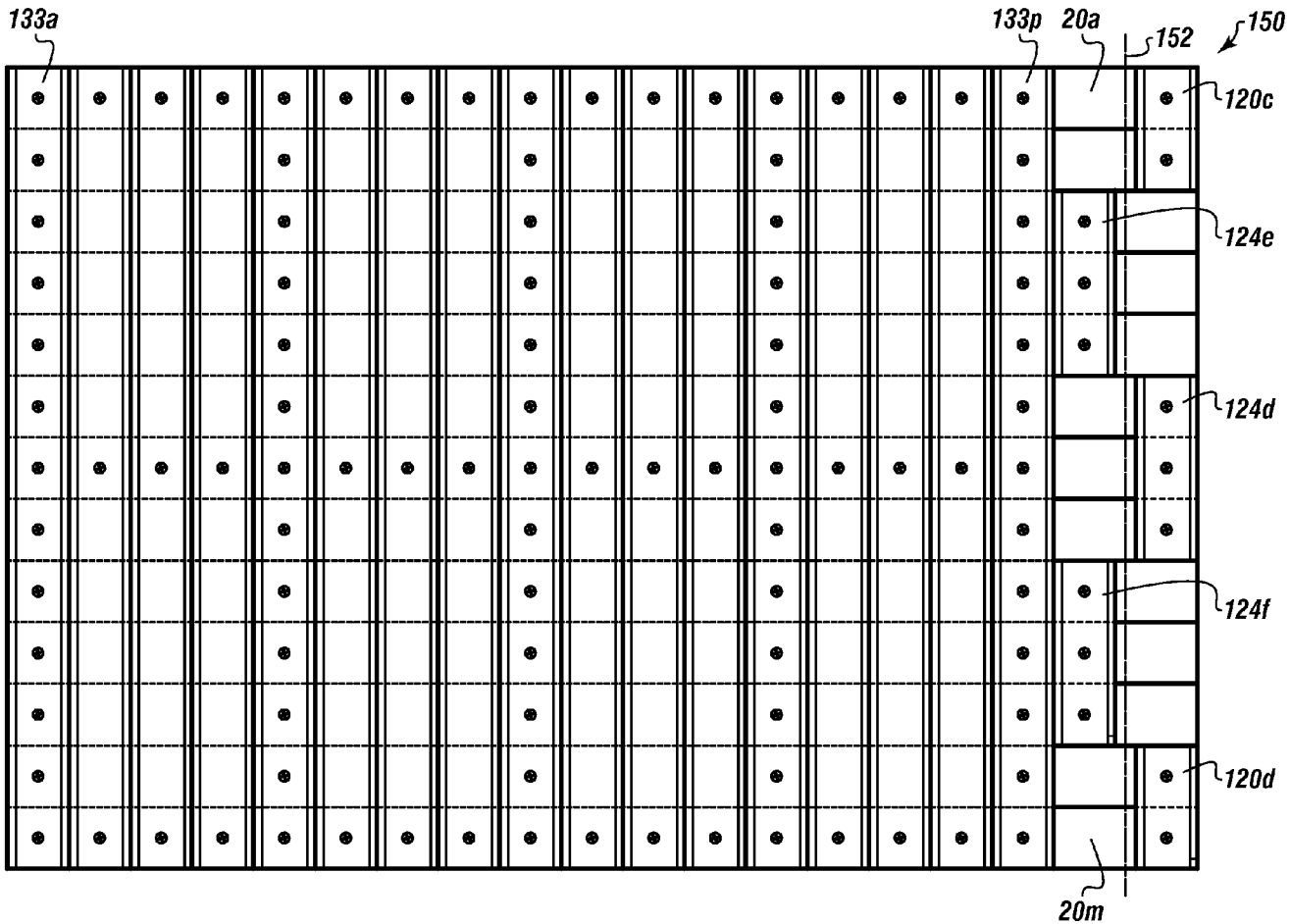
FIG. 2C depicts a bottom view of a top layer portraying a top interlocking segment formed on the top layer on the same side that the top layer connects to the middle layer.

FIG. 2C depicts a bottom view of a top layer portraying a top interlocking segment formed on the top layer on the same side that the top layer connects to the middle layer.

The top interlocking segment 150 has a top interlocking segment centerline 152.

A first top half aligned locking board 120*c* is mounted adjacent the first top layer side and adjacent the top interlocking segment centerline 152 and configured to prevent lateral and longitudinal movement of either an additional interlocking full mat or an additional interlocking half mat.

A second top half aligned locking board 120*d* can be mounted adjacent the second top layer side and adjacent the top interlocking segment center line 152 to prevent lateral and longitudinal movement of either an additional interlocking full mat or an additional interlocking half mat.

A first top full aligned locking board 124*d* can be spaced apart from and mounted between the first and second top half aligned locking boards 120*c* and 120*d*.

The first top full aligned locking board 124*d* can be mounted adjacent to the top interlocking segment centerline 152 and configured to prevent lateral and longitudinal movement of either an additional interlocking full mat or an additional interlocking half mat.

The first and second top half aligned locking boards 120*c* and 120*d* and the first top full aligned locking board 124*d* can be positioned on identical sides of the top interlocking segment centerline 152.

A second top full aligned locking board 124*e* can be mounted between the first top half aligned locking board 120*c* and the first top full aligned locking board 124*d* and mounted adjacent to the top interlocking segment centerline 152 and configured to prevent lateral and longitudinal movement of either an additional interlocking full mat or an additional interlocking half mat.

The second top full aligned locking board can be spaced from about 1.5 and 2 board widths from the first top layer side.

A third top full aligned locking board 124*f* can be mounted between the first top full aligned locking board 124*d* and the second top half aligned locking board 120*d* to prevent lateral and longitudinal movement of either an additional interlocking full mat or an additional interlocking half mat.

The third top full aligned locking board 124*f* can be spaced from about 1.5 and 2 board widths from the second top layer side.

The second and third full aligned locking boards can be positioned on identical sides of the top interlocking segment centerline 152.

Also shown in this Figure are the plurality of top beveled boards 20*a* and 20*m* and the plurality of middle layer boards 133*a* and 133*p*.

Figure 3A:
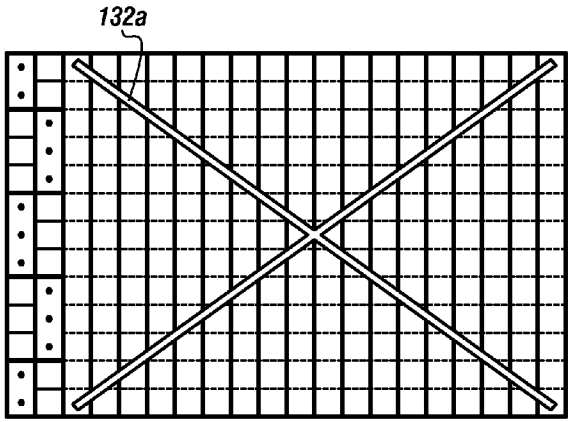
FIG. 3A depicts the alignment control means in the shape of an "X".

FIG. 3A depicts the alignment control means 132*a* in the shape of a "X" crossing all of the bottom layer boards from extreme corner to extreme corner, while connecting to all boards of the bottom layer at least once.

Figure 3B:
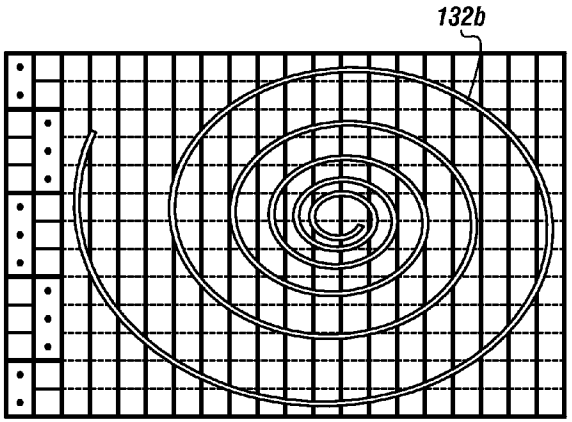
FIG. 3B depicts the alignment control means in the shape of spiral.

FIG. 3B depicts the alignment control means 132*b* in the shape of a spiral connecting to all boards of the bottom layer at least once.

Figure 3C:
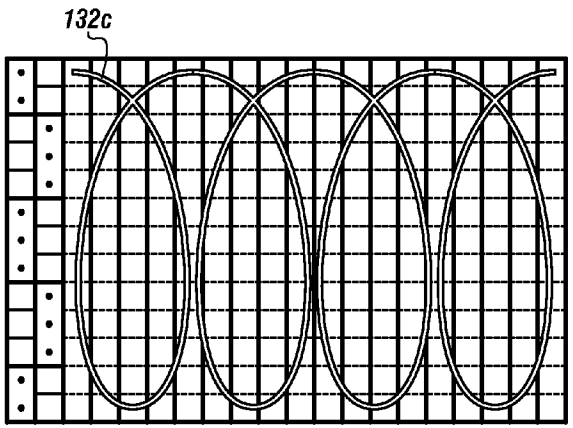
FIG. 3C depicts the alignment control means in the shape of a helix.

FIG. 3C depicts the alignment control means 132*c* in the shape of a helix connecting to all boards of the bottom layer at least once.

Figure 3D:
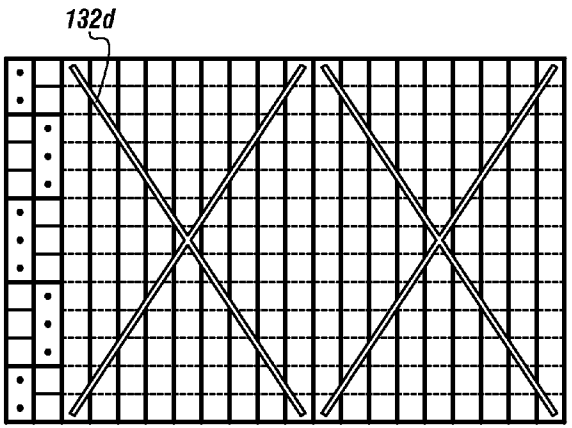
FIG. 3D depicts the alignment control means in the shape of a double "XX".

FIG. 3D depicts the alignment control means 132*d* in the shape of two "XX" and connecting to all boards of the bottom layer at least once but only being on 50 percent of the length of the boards.

Figure 3E:
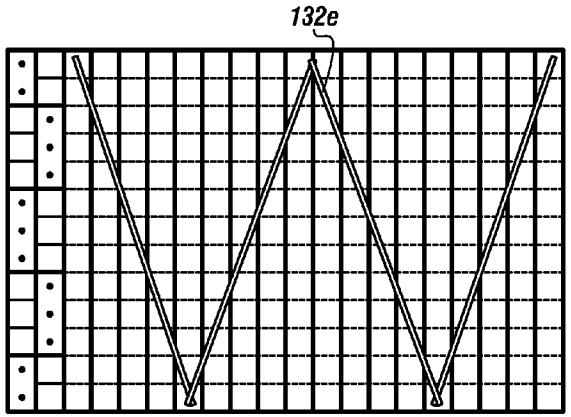
FIG. 3E depicts the alignment control means in the shape of a "W".

FIG. 3E depicts the alignment control means 132*e* in the shape of a "W" connecting to all boards of the bottom layer at least once.

Figure 3F:
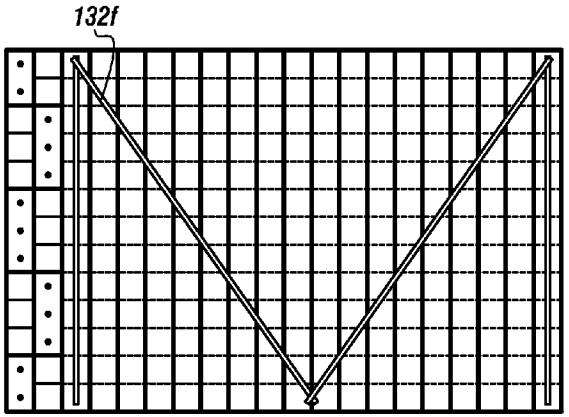
FIG. 3F depicts the alignment control means in the shape of an "M".

FIG. 3F depicts the alignment control means 132*f* in the shape of an "M" connecting to all boards of the bottom layer at least once.

Figure 3G:
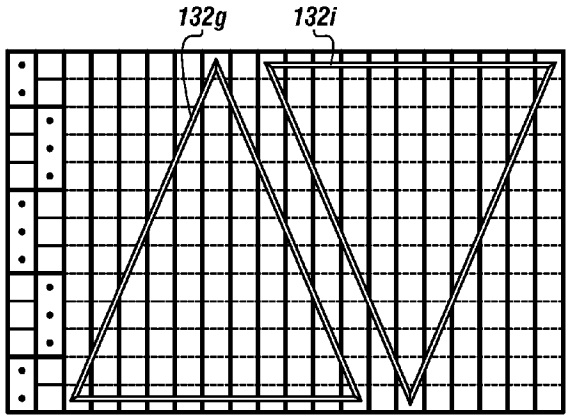
FIG. 3G depicts the alignment control means in the shape of two triangles.

FIG. 3G depicts the alignment control means 132*g* and 132*i*, wherein the alignment control means 132*g* is in the shape of a first triangle, and alignment control means 132*i* is in the shape of a second triangle. The two triangles connect to all boards of the bottom layer at least once.

Figure 3H:
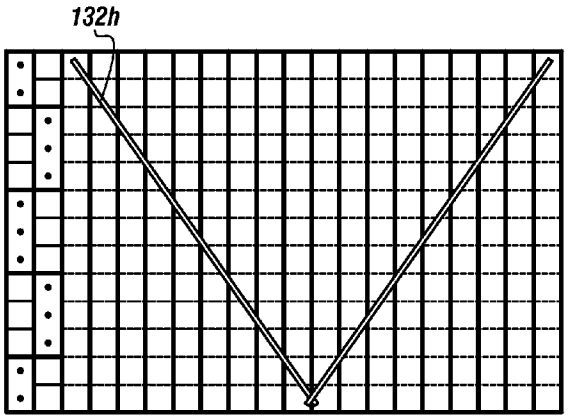
FIG. 3H depicts the alignment control means in the shape of a "V".

FIG. 3H depicts the alignment control means 132*h* in the shape of a "V" connecting to all boards of the bottom layer at least once.

Figure 4:
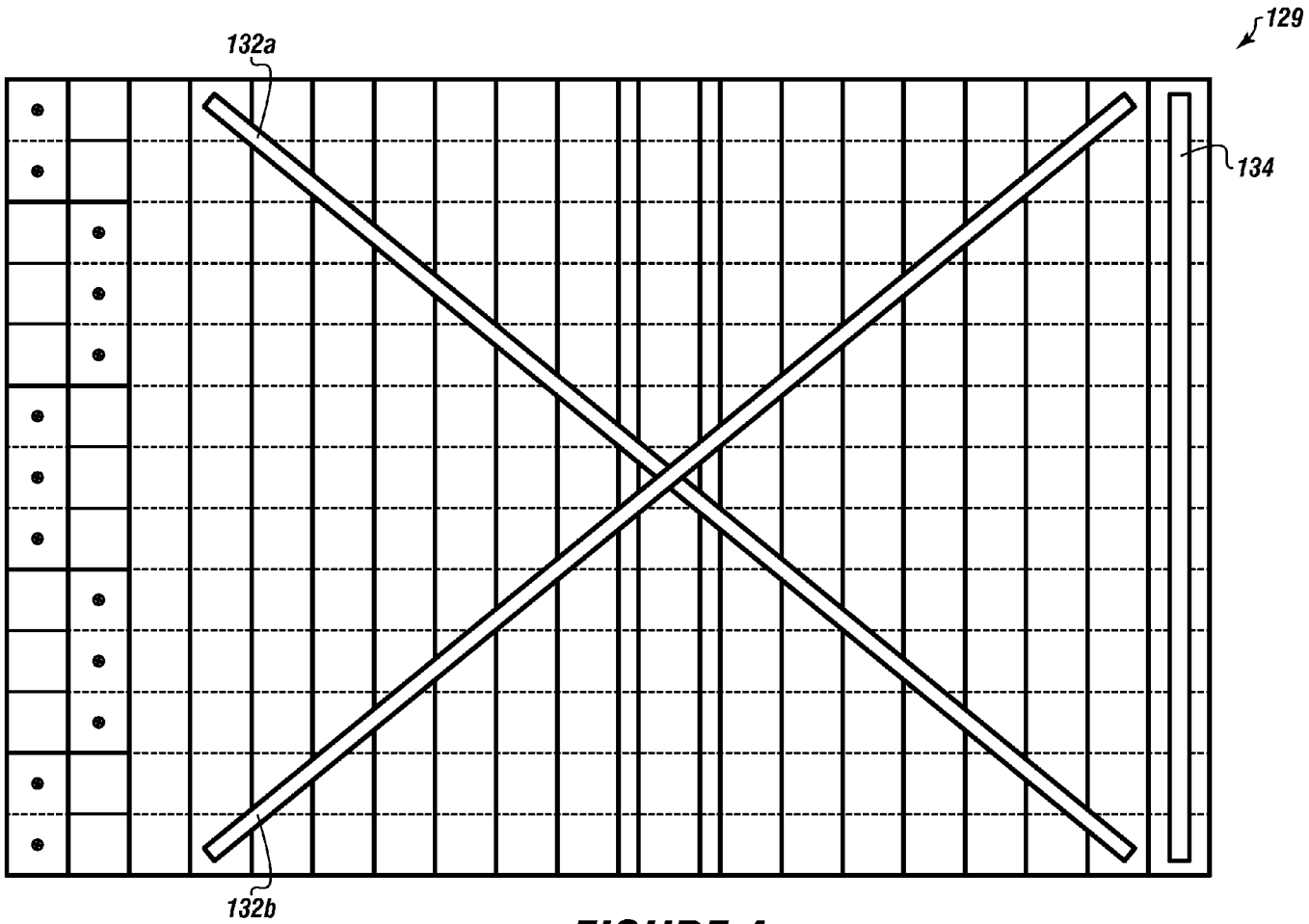
FIG. 4 is a top view of a middle layer disposed over a bottom layer of a full mat with an installed alignment control means.

FIG. 4 is a top view of a middle layer disposed over a bottom layer of a full mat with an installed alignment control means.

In this view the alignment control means 132 and an anti-curling bar 134 is positioned over the middle layer 129. The anti-curling bar can help prevent curling by the top layer.

The anti-curling bar 134 can be disposed between the middle layer and the top layer connecting across all of the boards of the top layer and the middle layer simultaneously.

Figure 5:
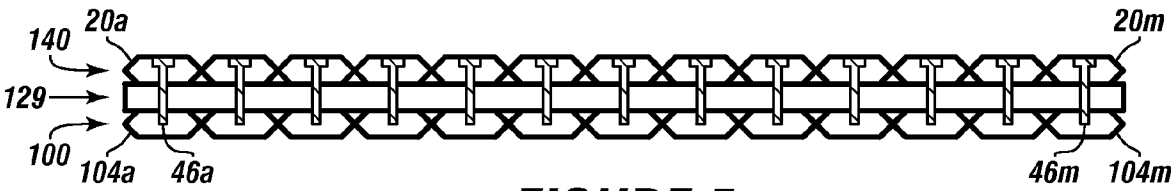
FIG. 5 is a side view of the three layers of an embodiment lengthwise of the oil field mat assembly connected with fasteners.

FIG. 5 shows the top layer from an end point, where the top layer is depicted on top of the middle layer and the middle layer is disposed on the bottom layer connected with fasteners.

The top layer 140 can be made of a plurality of top beveled boards 20*a* and 20*m*, which can be parallel, forming a top layer orientation at a right angle to the middle layer orientation.

The top layer 140, the middle layer 129, and the bottom layer 100 can be connected using fasteners 46*a* and 46*m*. The fasteners 46*a* and 46 can be seen extending from the top layer through the middle and partially into the plurality of bottom layer boards 104*a* and 104*m*.

In one or more embodiments, from 3 fasteners to 20 fasteners can be installed through each top layer board through middle layer boards to bottom layer boards per mat providing electrical conduction to reduce static build up on the boards.

Figure 6:
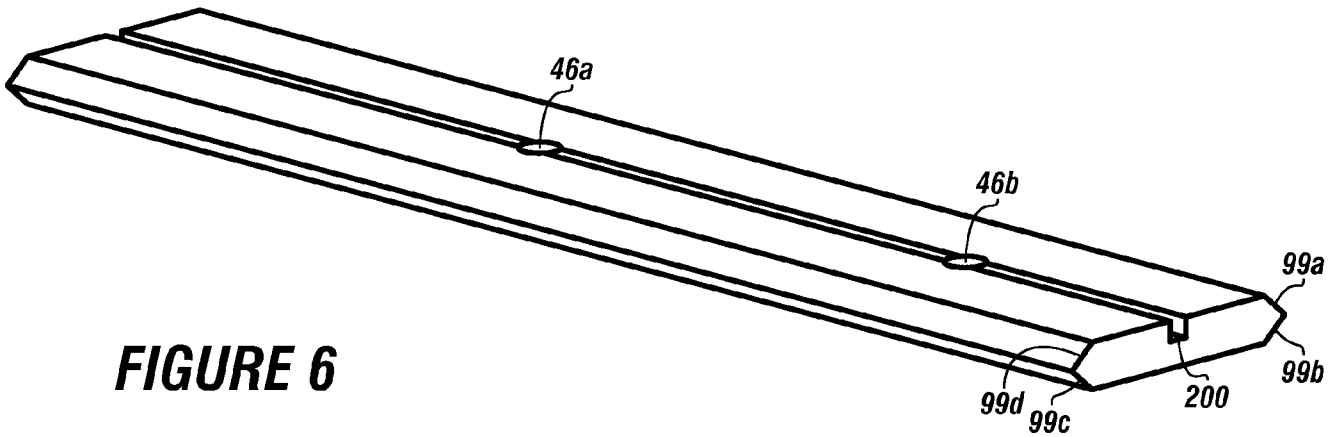
FIG. 6 show a view of the groove used with beveled boards according to one or more embodiments.

FIG. 6 show a view of the groove used with beveled boards according to one or more embodiments.

In one or more embodiments, a plurality of beveled board having bevels 99*a*, 99*b*, 99*c*, and 99*d* can be used. The beveled board having bevels 99*a*, 99*b*, 99*c*, and 99*d* can each have a central groove on each longitudinal side.

The two fasteners 46*a* and 46*b* are shown extending through the groove 200 into another board.

In embodiments, a middle layer orientation of the middle layer is a right angle to the bottom layer orientation and the top layer orientation.

In an embodiment, the fasteners can be screws, bolts, nails, epoxy, or combinations thereof.

In an embodiment, the boards can comprise wood, low density polyethylene, high density polyethylene, copolymers of low density of polyethylene, other plastic material, natural rubber, synthetic rubber, styrene butadiene resin or combinations and blends thereof.

In an embodiment, the boards can be blends of polyethylene and rubber.

In an embodiment, the layers of each mat can each comprise a different material with different physical properties, including different durometers and different brittleness.

In an embodiment, the top layer can be a low density polyethylene, the middle layer can be low density polyethylene, and the bottom layer can be wood. This assemblage can provide improved rigidity of the mat.

In an embodiment, the boards can be made from 50 weight percent to 75 weight percent low density polyethylene; 10 weight percent to 35 weight percent high density polyethylene; 1.0 weight percent to 5.0 weight percent filler; 0.1 weight percent to 0.5 weight percent ultraviolet stabilizers; and 8.0 weight percent to 15 weight percent antistatic carbon black.

In an embodiment, the formulation can be formed from at least one of the following: 1.0 weight percent to 3.5 weight percent styrene butadiene resin; 0.5 weight percent to 1.0 weight percent sodium bicarbonate; 0.5 weight percent to 3.5 weight percent ethyl vinyl acetate; 1.5 weight percent to 3.5 weight percent polyamide; 1.0 weight percent to 10 weight percent polyester; and 0.5 weight percent to 2 weight percent pigment which can be yellow pigment, red pigment, black pigment, or another pigment which can include a reflective material.

In an embodiment, the top layer can includes top beveled boards, each having a groove disposed longitudinally in each board for slip resistance.

In an embodiment, from 3 fasteners to 20 fasteners can be installed through each top layer board, middle layer boards to bottom layer boards per mat.

In an embodiment, from 13 fasteners to 247 fasteners can be installed through top layer boards, middle layer boards to bottom layer boards per mat.

In an embodiment, from 10 fasteners to 48 fasteners can be installed through boards on the couplers to connect the layers of each coupler together.

While these embodiments have been described with emphasis on the embodiments, it should be understood that within the scope of the appended claims, the embodiments might be practiced other than as specifically described herein.

What is claimed is:

1. An oil field mat assembly having a pair of interlocking full mats connected by interlocking half mats, wherein each full mat comprises:

a) a bottom layer comprising:
  (i) a bottom layer orientation;
  (ii) a plurality of bottom layer boards connected in parallel to each other, wherein each board has an identical board width; and
  (iii) a first bottom layer side, a second bottom layer side opposite the first bottom layer side, a third bottom layer side, and a fourth bottom layer side opposite the third bottom layer side between the first and second bottom layer sides;

b) a bottom interlocking segment formed on the bottom layer comprising:
  (i) a interlocking segment centerline passing from the first bottom layer side to the second bottom layer side;
  (ii) a first half aligned locking board mounted adjacent the first bottom layer side and adjacent the interlocking segment centerline and configured to prevent lateral and longitudinal movement of either an additional interlocking full mat or an additional interlocking half mat;
  (iii) a second half aligned locking board mounted flush with the second bottom layer side and adjacent the interlocking segment center line to prevent lateral and longitudinal movement of either an additional interlocking full mat or an additional interlocking half mat;
  (iv) a first full aligned locking board spaced apart from and mounted between the first and second half aligned locking boards, wherein the first full aligned locking board is mounted adjacent the interlocking segment centerline and configured to prevent lateral and longitudinal movement of either an additional interlocking full mat or an additional interlocking half mat, and wherein the first and second half aligned locking boards and the first full aligned locking board are positioned on identical sides of the interlocking segment centerline;
  (v) a second full aligned locking board mounted between the first half aligned locking board and the first full aligned locking board and mounted adjacent to the interlocking segment centerline and configured to prevent lateral and longitudinal movement of either an additional interlocking full mat or an additional interlocking half mat, wherein the second full aligned locking board is spaced from 1.5 to 2 board widths from the first bottom layer side; and
  (vi) a third full aligned locking board mounted between the first full aligned locking board and the second half aligned locking board to prevent lateral and longitudinal movement of either an additional interlocking full mat or an additional interlocking half mat, wherein the third full aligned locking board is spaced from 1.5 to 2 board widths from the second bottom layer side, and wherein the second and third full aligned locking boards are positioned on identical sides of the interlocking segment centerline;

c) a middle layer formed from a plurality of middle layer boards forming a middle layer orientation at a right angle to the bottom layer orientation;

d) an alignment control means to maintain a preset geometric shape, wherein the alignment control means is disposed between the middle layer and the bottom layer;

e) a top layer comprising a plurality of top beveled boards forming a top layer orientation at a right angle to the middle layer orientation;

f) a top interlocking segment formed on the top layer on the same side that the top layer connects to the middle layer, wherein the top interlocking segment comprises:
  (i) a top interlocking segment centerline;
  (ii) a first top half aligned locking board mounted adjacent the first top layer side and adjacent the top interlocking segment centerline and configured to prevent lateral and longitudinal movement of either an additional interlocking full mat or an additional interlocking half mat;
  (iii) a second top half aligned locking board mounted adjacent to the second top layer side and adjacent to the top interlocking segment center line to prevent lateral and longitudinal movement of either an additional interlocking full mat or an additional interlocking half mat;
  (iv) a first top full aligned locking board spaced apart from and mounted between the first and second top half aligned locking boards, wherein the first top full aligned locking board is mounted adjacent to the top interlocking segment centerline and configured to prevent lateral and longitudinal movement of either an additional interlocking full mat or an additional interlocking half mat, and wherein the first and second top half aligned locking boards and the first top full aligned locking board are positioned on identical sides of the top interlocking segment centerline;

(v) a second top full aligned locking board mounted between the first top half aligned locking board and the first top full aligned locking board and mounted adjacent the top interlocking segment centerline and configured to prevent lateral and longitudinal movement of either an additional interlocking full mat or an additional interlocking half mat, wherein the second top full aligned locking board is spaced from 1.5 to 2 board widths from the first top layer side; and (vi) a third top full aligned locking board mounted between the first top full aligned locking board and the second top half aligned locking board to prevent lateral and longitudinal movement of either an additional interlocking full mat or an additional interlocking half mat, wherein the third top full aligned locking board is spaced from 1.5 to 2 board widths from the second top layer side, and wherein the second and third full aligned locking boards are positioned on identical sides of the top interlocking segment centerline; and g) an anti-curling bar to prevent curling by the top layer mounted between the middle layer and the top layer connecting across all of the boards of the top layer and the middle layer.

2. The oil field mat assembly of claim 1, wherein the alignment control means is aluminum bar, plastic, wood, steel, graphite, composite, wire mesh, or combinations thereof.

3. The oil field mat assembly of claim 1, wherein the alignment control means forms a helix, a spiral, an X-shape, a pair of X-shapes, a W-shape, an M-shape, a pair of triangles, a V-shape, or combinations thereof covering at least 25 percent of the length of the boards.

4. The oil field mat assembly of claim 1, wherein the plurality of bottom layer boards are beveled.

5. The oil field mat assembly of claim 1, wherein the plurality of top beveled boards each have a groove disposed longitudinally in each board for slip resistance.

6. The oil field mat assembly of claim 5, wherein the groove is centrally disposed on a top side of the plurality of top beveled boards.

7. The oil field mat assembly of claim 1, wherein the top layer, middle layer, and bottom layer are connected to each other by at least one fastener.

8. The oil field mat assembly of claim 7, wherein the top layer, middle layer, and bottom layer are connected to each other by a plurality of fasteners, the plurality of fasteners comprising a screw, a bolt, a nail, an epoxy, or combinations thereof.

9. The oil field mat assembly of claim 1, wherein each of the boards comprise wood, low density polyethylene, high polyethylene, copolymers of low density of polyethylene, other plastic material, natural rubber, synthetic rubber, styrene butadiene resin or combinations thereof.

10. The oil field mat assembly of claim 1, wherein each of the boards consists of blends of polyethylene and rubber.

11. The oil field mat assembly of claim 1, wherein each layer of each mat comprises a different material with different physical properties, including different durometers and different brittleness.

12. The oil field mat assembly of claim 1, wherein the top layer is a low density polyethylene, middle layer is low density polyethylene, and the bottom layer is wood.

13. The oil field mat assembly of claim 1, wherein the formulation for each board comprises:

a) 50 weight percent to 75 weight percent low density polyethylene;

b) 10 weight percent to 35 weight percent high density polyethylene;

c) 1.0 weight percent to 5.0 weight percent filler;

d) 0.1 weight percent to 0.5 weight percent ultraviolet stabilizers; and e) 8.0 weight percent to 15 weight percent antistatic carbon black.

14. The oil field mat assembly of claim 13, wherein the formulation further comprises at least one of the following:

a) 1.0 weight percent to 3.5 weight percent styrene butadiene resin;

b) 0.5 weight percent to 1.0 weight percent sodium bicarbonate;

c) 0.5 weight percent to 3.5 weight percent ethyl vinyl acetate;

d) 1.5 weight percent to 3.5 weight percent polyamide;

e) 1.0 weight percent to 10 weight percent polyesters; and f) 0.5 weight percent to 2 weight percent pigment.

* * * * *